US006070877A

United States Patent [19]

Saint-Victor

[11] Patent Number: 6,070,877

[45] Date of Patent: Jun. 6, 2000

[54] DECK OF CARDS HAVING SIX SETS OF SIX SUITS

[76] Inventor: Emmanuel Saint-Victor, P.O. Box 450991, Atlanta, Ga. 31145

[21] Appl. No.: 09/013,076

[22] Filed: Jan. 26, 1998

[51] Int. Cl.[7] ..... A63F 1/00

[52] U.S. Cl. ..... 273/303; 273/306

[58] Field of Search ..... 273/303–306, 273/296, 308

[56] References Cited

U.S. PATENT DOCUMENTS 1,357,166 10/1920 Hart ..... 273/303
3,072,408 1/1963 Haak ..... 273/303
4,955,619 9/1990 Christman ..... 273/303
5,112,059 5/1992 Mundle et al. ..... 273/308

*Primary Examiner*—Benjamin H. Layno
*Attorney, Agent, or Firm*—Hughes & Kaplan; Barry E. Kaplan, Esq.

[57] ABSTRACT

A card game for play by a plurality of players in which players play group of cards that include one or more. The card game includes six pack of cards designed for the game each packs containing six suits: birds, butterflies, flowers, horses, fish, turtles. The object of "challenge" is to be the first player to reach 1000 points and thus secure your title "genius" or "winner" of the game. Opponents will make "declarations", "tips", use the turtle and other strategies to slow you down and keep you from reaching your goal.

7 Claims, 19 Drawing Sheets

Joker
Bird
21
22
23
24
25
26

Joker
Butterfly
22
21
25
26
24
23

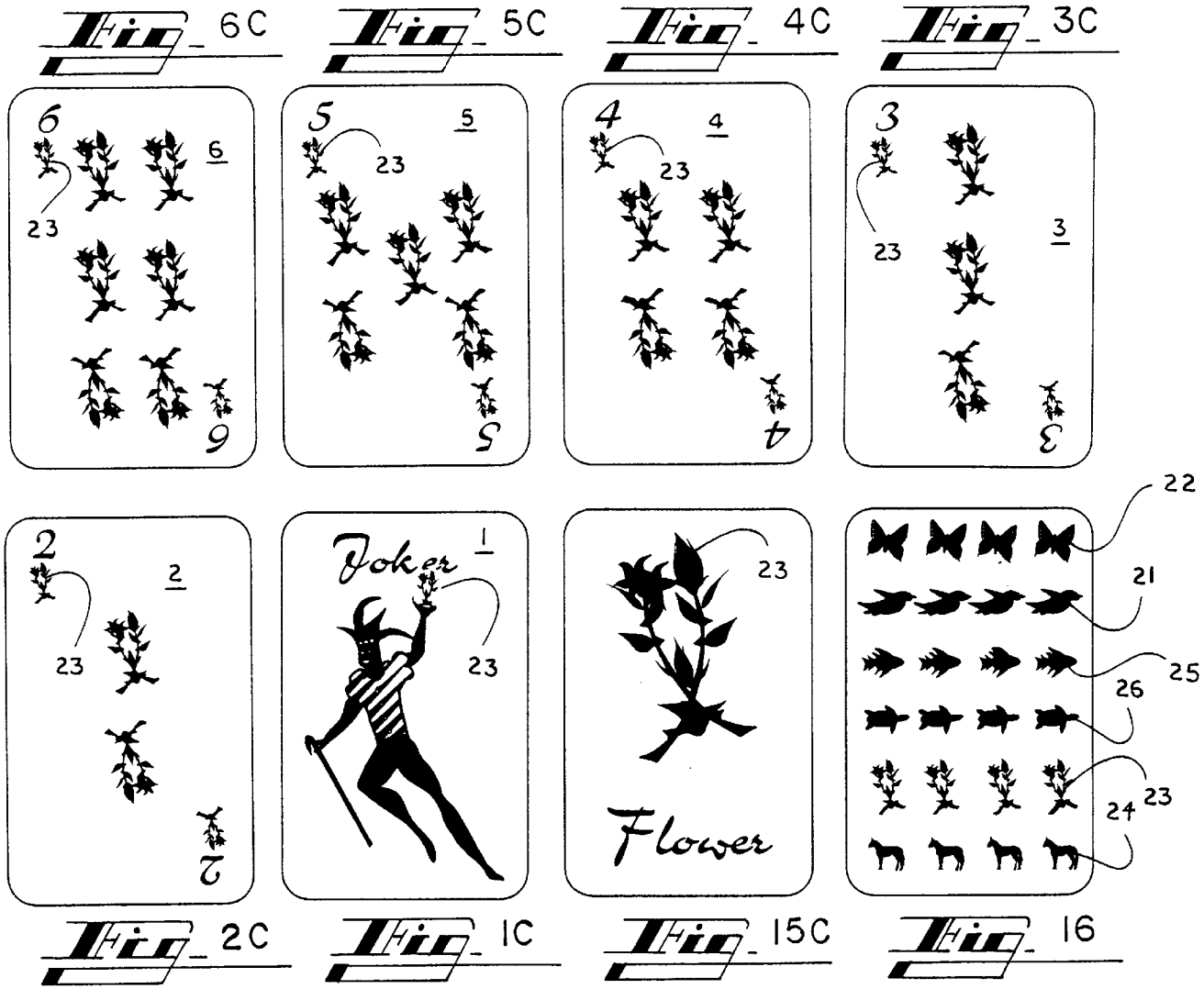
6C
5C
4C
3C
2C
1C
15C
16
Joker
Flower
1
2
3
4
5
6
21
22
23
24
25
26

Poker
Horse
1
2
3
4
5
6
21
22
23
24
25
26
27

Joker
Fish
25
22
21
26
23
24

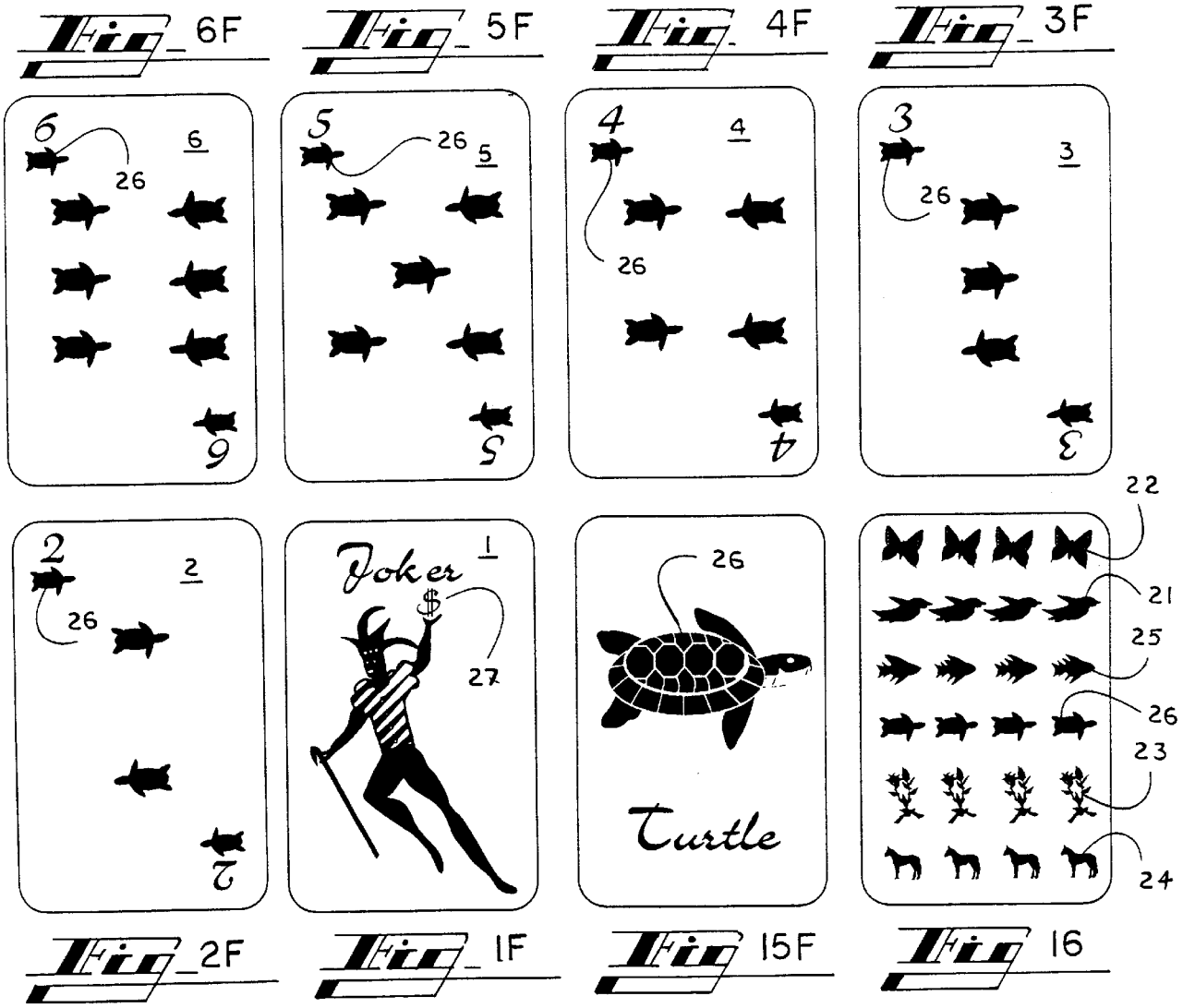
3F
4F
5F
6F
16
15F
1F
2F
Turtle
Joker
1
2
3
4
5
6
21
22
23
24
25
26
27

14
13
12
11
10
9
8
7
21

14
13
12
11
10
9
8
7
22

14
13
12
11
10
9
8
7
23

14
13
12
11
10
9
8
7
24

14
13
12
11
10
9
8
7
25

14
13
12
11
10
9
8
7
26

FORMATIONS AND VALUES OF DECLARATIONS

| Formations | Values |
|---|---|
| Trump Marriage | 40 points |
| Normal Marriage | 20 points |
| 6 Aces trump or 5 aces (trump) + $Joker | 300 points |
| 6 Aces (any suit combination) or 5 Aces + (1) Joker any suits | 150 points |
| 6 Kings trump or 5 Kings (Trump) + $Joker | 240 points |
| 6 Kings (any suit combination) or 5 King + (1) Joker any suits | 120 points |
| 6 Queens (trump) or 5 aces (trump) + $Joker | 180 points |
| 6 Queens (any suit combination) or 5 Queens + (1) Joker any suit | 90 points |
| 6 Jacks (Trump) or 5 Jacks (Trump) + $Joker | 120 points |
| 6 Jacks (any suit combination) or 5 Jacks + (1) $Joker | 60 points |
| Escalator sequence (A, K, Q, J, 10) **Trump suit only** | 250 Declarer<br>-150 Leader |
| Full sequence (A, K, Q, J, 10, 9, 8, 7) **Trump suit only** | 300 Declarer<br>-150 Leader |
| Full garbage sequence (5) 7s, (3) 8s, (3) 9s **Trump suit only** | 300 Declarer<br>-150 Leader |
| **Horse sequences can only be declared while being "leader"** | |
| Escalator (A, K, Q, J, 10) leader only | 250 points |
| 5 Aces (Horses) or 4 Aces (Horses) + (1) $ Joker | 150 points |
| 5 Kings (Horses) or 4 Kings (Horses) + (1) $Joker | 120 points |
| 5 Queens (Horses) or 4 Queens (Horses) + (1) $Joker | 90 points |
| 5 Jacks (Horses) or 4 Jacks (Horses) + (1) $Joker | 60 points |
| **Turtles sequences cannot be declared by "leader"** | |
| Escalator (turtles) (A, K, Q, J, 10) | 250 Declarer<br>-250 Leader |
| 5 Aces (Turtles) or 4 Aces (Turtles) + (1) $Joker | 150 Declarer<br>-150 Leader |
| 5 King (Turtles) or 4 Kings (Turtles) + (1) $Joker | 120 Declarer<br>-120 Leader |
| 5 Queens (Turtles) or 4 Queens (Turtles) + (1) $Joker | 90 Declarer<br>-90 Leader |
| 5 Jacks (Turtles) or 4 Jacks (Turtles) + (1) $Joker | 60 Declarer<br>-60 Leader |
| **Jokers sequences** | |
| 5 Jokers (trump suit) or 4 Jokers (trump suit) + (1) $Joker | 150 points |
| 5 Jokers horses or 4 Jokers (horses) + $Joker (leader only) | 150 points (leader) |
| 5 Jokers Turtles or 4 Jokers (turtles) + (1) $Joker (cannot be declared by leader) | 150 points (non-leader)<br>-150 points (leader) |

Note: Anyone that plays a turtle without having a declaration or having a set or sequence in turtles will lose 10 points.
No players scores can'ever be lower than zero.

Seven's

The seven's in the trump suit are worth 10 points each, any time you use it to cut. Seven's of horses are worth 10 points if played by the Leader. Seven of turtles knock 10 points off the Leader and give 10 point to the player.

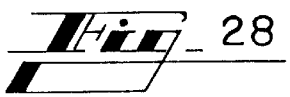

DECK OF CARDS HAVING SIX SETS OF SIX SUITS

FIELD AND BACKGROUND OF THE INVENTION

Many different types of card games have been proposed in attempt to provide a game that requires skill and strategy and that is exciting and challenging. For example "Bezique". The standard game of Bezique is played by two players, with two packs of cards from which the 6s, 5s, 4s, 3s and 2s have been removed. The cards rank in the order: A, 10, K, Q, J, 9, 8, 7. Eight cards are dealt to each player in packets of three, two, three. The remaining forty-eight cards (the stock) are placed face downwards on the table, and the dealer exposes the top card to determine the trump suit. It is placed alongside the stock, and if it is a 7 he scores 10 points. The non-dealer leads to the first trick. As at most games the winner of a trick leads to the next, but it is a feature of bezique that a player is under no obligation to follow suit to the card led. The object of the game is to score points for declaring certain cards and combinations of cards. The score cannot be kept satisfactorily with pencil on paper. It is best to use the special bezique markers that take the form of indicators marked as clocks on thin cardboard.

While the foregoing game provide a certain amount of amusement and entertainment, the amount of skill and strategy involved in playing the game is rather limited. As a consequence, there exists a need for a card game that requires skill and strategy but which is exciting, interesting, and not complicated to play, thereby appealing to an audience that includes children as well as adults, religious groups, professionals, hospitals, schools, lovers, and probably the best game for teenagers to spend their time without getting involved in alcohol or drugs.

There also exists a need for a game that provides an element of unpredictability for creating surprises and for lessening the intensity of the game. In other types of game the players can readily predict the strength of the cards in their hands by keeping track of the cards played. Thus, those games can be quite intense in that players know when they will be able to prevail with a particular hand. A player is never really certain that the cards he has in his hand are higher than the cards in the hands of the other players. As a result, an element of surprise always exists, and the game tends to be more exciting and less intense.

Furthermore exists the need of a card game that contains a suit which will lower the amount of points of the leader when declared by his opponent(s), while there is another suit that only the leader can use to make declarations.

In view of the foregoing disadvantages inherent in the known types of card games now present in the prior art, the present invention provides an improved card game design and method wherein card playing skill can be utilized. As such, the general purpose of the present invention, which will be described subsequently in greater detail, is to provide a new and improved card game and method for playing which has all the advantages of the prior art card games and none of the disadvantages.

SUMMARY OF THE INVENTION

To transcend the foregoing objectives, the card game of the present invention includes a deck of cards having a plurality of sets that each contains a plurality of cards. The invention game contains 504 cards, which are six sets of cards. Each set consists of six suits which follow the sequence: joker, 2, 3, 4, 5, 6, 7, 8, 9, 10, J, Q, K, A. The six suits are: birds, butterflies, flowers, horses, fish, turtles.

"Challenge" as the invention is called uses "scorulators" to keep track of points. The game also is provided with a guider which contains formations and values of declarations.

TERMS USED IN CHALLENGE

A=Aces

K=Kings

Q=Queens

J=Jacks

Leader: The leading scorer at any point in the game.

Declaration: Made by putting down any combination of cards that has a total point value.

Marriage: Declaration of a King and Queen of the same suit.

Trump Marriage: The first marriage made by any player. This determines the trump suit.

Trump: Any playing card included in the trump suit. The trump suit ranks higher than any other suit.

Exception: Horses and turtles can't be a trump suit.

Tips: Aces and 10s captured during the hand. Each counts for 10 extra points only if you have collected 5 or more tips at the end of the hand.

Stock: Cards won from tricks.

Trick: When each player plays a card the highest wins.

FORMATIONS AND VALUES OF DECLARATIONS

| Formations | Values |
|---|---|
| Trump Marriage | 40 points |
| Normal Marriage | 20 points |
| 6 Aces trump or 5 aces (trump) + $Joker | 300 points |
| 6 Aces (any suits combination) or 5 Aces + (1) Joker any suit | 150 points |
| 6 Kings trump or 5 Kings (Trump) + $Joker | 240 points |
| 6 Kings (any suits combination) or 5 Kings + (1) Joker any suit | 120 points |
| 6 Queens (trump) or 5 aces (trump) + $Joker | 180 points |
| 6 Queens (any suits combination) or 5 Queens + (1) Joker any suit | 90 points |
| 6 Jacks (Trump) or 5 Jacks (Trump) + $Joker | 120 points |
| 6 Jacks (any suits combination) or 5 Jacks + (1) Joker any suit | 60 points |
| Escalator sequence (A, K, Q, J, 10) Trump suit only | 250 Declarer |
| | −150 Leader |
| Flush sequence (A, K, Q, J, 10, 9, 8, 7) Trump suit only | 300 Declarer |
| | −150 Leader |
| | 300 Declarer |
| Full garbage sequence (3) 7s, (3) 8s, (3) 9s Trump suit only | −150 Leader |

-continued

FORMATIONS AND VALUES OF DECLARATIONS

| Formations | Values |
|---|---|
| Horses sequences can only be declared while being "leader" | 250 points |
| Escalator (A, K, Q, J, 10) leader only | 150 points |
| 5 Aces (Horses) or 4 Aces (Horses) + (1) $ Joker | 120 points |
| 5 Kings (Horses) or 4 Kings (Horses) + (1) $Joker | 90 points |
| 5 Queens (Horses) or 4 Queens (Horses) + (1) $Joker | 60 points |
| 5 Jacks (Horses) or 4 Jacks (Horses) + (1) $Joker | |
| Turtles sequences cannot be declared by "leader" | 250 Declarer |
| Escalator (turtles) (A, K, Q, J, 10) | −250 Leader |
| | 150 Declarer |
| 5 Aces (Turtles) or 4 Aces (Turtles) + (1) $Joker | −150 Leader |
| | 120 Declarer |
| 5 King (Turtles) or 4 Kings (Turtles) + (1) $Joker | −120 Leader |
| | 90 Declarer |
| 5 Queens (Turtles) or 4 Queens (Turtles) + (1) $Joker | −90 Leader |
| | 60 Declarer |
| 5 Jacks (Turtles) or 4 Jacks (Turtles) + (1) $Joker | −60 Leader |
| Jokers sequences | 150 points |
| 5 Jokers (trump suit) or 4 Jokers (trump suit) + (1) $Joker | 150 points (leader) |
| 5 Jokers horses or 4 Jokers (horses) + $Joker (leader only) | 150 points (declarer) |
| 5 Jokers Turtles or 4 Jokers (turtles) + (1) $Joker (cannot be declared by leader) | −150 points (leader) |

Note: Anyone that plays a turtle without having a declaration or having a set or sequence in turtles will lose 10 points.
No players scores can ever be lower than zero.

Seven's

The seven's in the trump suit are worth 10 points each, any time you use it to cut. Seven's of horses are worth 10 points if played by the Leader. Seven of turtles knock 10 points off the Leader and give 10 point to the player.

The object of Challenge is to be the first player to reach 1000 points and thus secure your title as Genius, or the winner of the game. Now remember, your opponent(s) will make declarations, tips, use the turtle and other strategies to slow you down and keep you from reaching your goal.

The game is played with 324 cards. 2s, 3s, 4s, 5s, 6s, are removed. To begin, if you are not skilled in the invention yet, take a guider put it on your right or left side, wherever you feel more comfortable, put it on the table where you are going to play so you can have available the rules and the points for declarations. Then take a scorulator to keep track of your points. Note that if you are playing in teams you only need 2 scorulators. One scorulator for each team. Shuffle the cards, the player to the left of the dealer cuts, and the one on the right gets the first card and will also be the first one to play. Each player is given 12 cards by group of 3 or 4 cards depending on dealer's choice. Remember the first marriage will be the trump suit. The winner of a trick:

(a) makes any declaration, (b) marks his/her points on the scorulators, (c) puts the cards in his/her stock, (d) replenishes his/her hands, and (e) leads the next trick, playing any card that they wish.

This process continues until the leader reaches 1000 points (or any total points agreed upon) to win the game and become the genius or the winner. Players should understand that whenever there is a tie in points, for the leadership, then they both are considered leaders, they will share the privileges and punishment until any player takes the lead. This game can be played by 2–8 players or more, but when playing with 5 players, 4 extra $Jokers must be removed. When playing with 7 players, 2 extra $Jokers must be removed.

BRIEF DESCRIPTION OF THE DRAWING

Preferred embodiments of the present invention will now be described in greater detail with reference to the accompanying drawing wherein like elements bear like reference numerals and wherein.

FIGS. 1A, 1B, 1C, 1D, 1E, 1F, are plan views of the front faces of one type of card used in the card game of the present invention.

FIGS. 2A, 2B, 2C, 2D, 2E, 2F are plan views of the front faces of one type of card used in the card game of the present invention.

FIGS. 3A, 3B, 3C, 3D, 3E, 3F are plan views of the front faces of one type of card used in the card game of the present invention.

FIGS. 4A, 4B, 4C, 4D, 4E, 4F are plan views of the front faces of one type of card used in the card game of the present invention.

FIGS. 5A, 5B, 5C, 5D, 5E, 5F are plan views of the front faces of one type of card used in the card game of the present invention.

FIGS. 6A, 6B, 6C, 6D, 6E, 6F are plan views of the front faces of one type of card used in the card game of the present invention.

FIGS. 15A, 15B, 15C, 15D, 15E, 15F are front faces of suits used in the card game of the invention.

FIG. 16 is a plan view of the rear face of each card illustrated in FIGS. 1A–14F.

FIG. 28 is an illustration of the values of declarations and their formation.

DETAILED DESCRIPTION OF THE PREFERRED EMBODIMENTS

Figures 1A, 2A, 3A, 4A, 5A, 6A, 15A, 16:
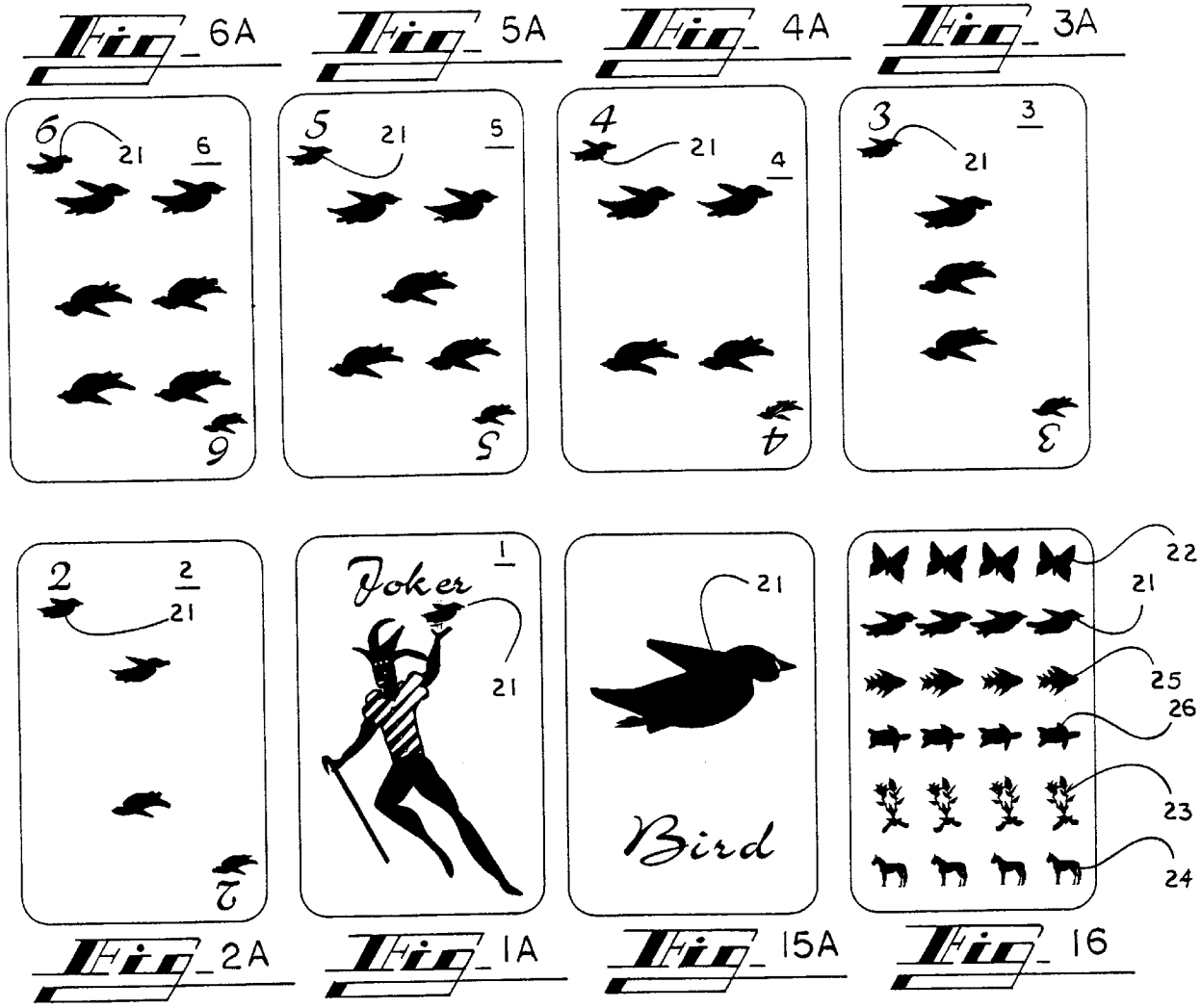
Figures 1B, 2B, 3B, 4B, 5B, 6B, 15B, 16:
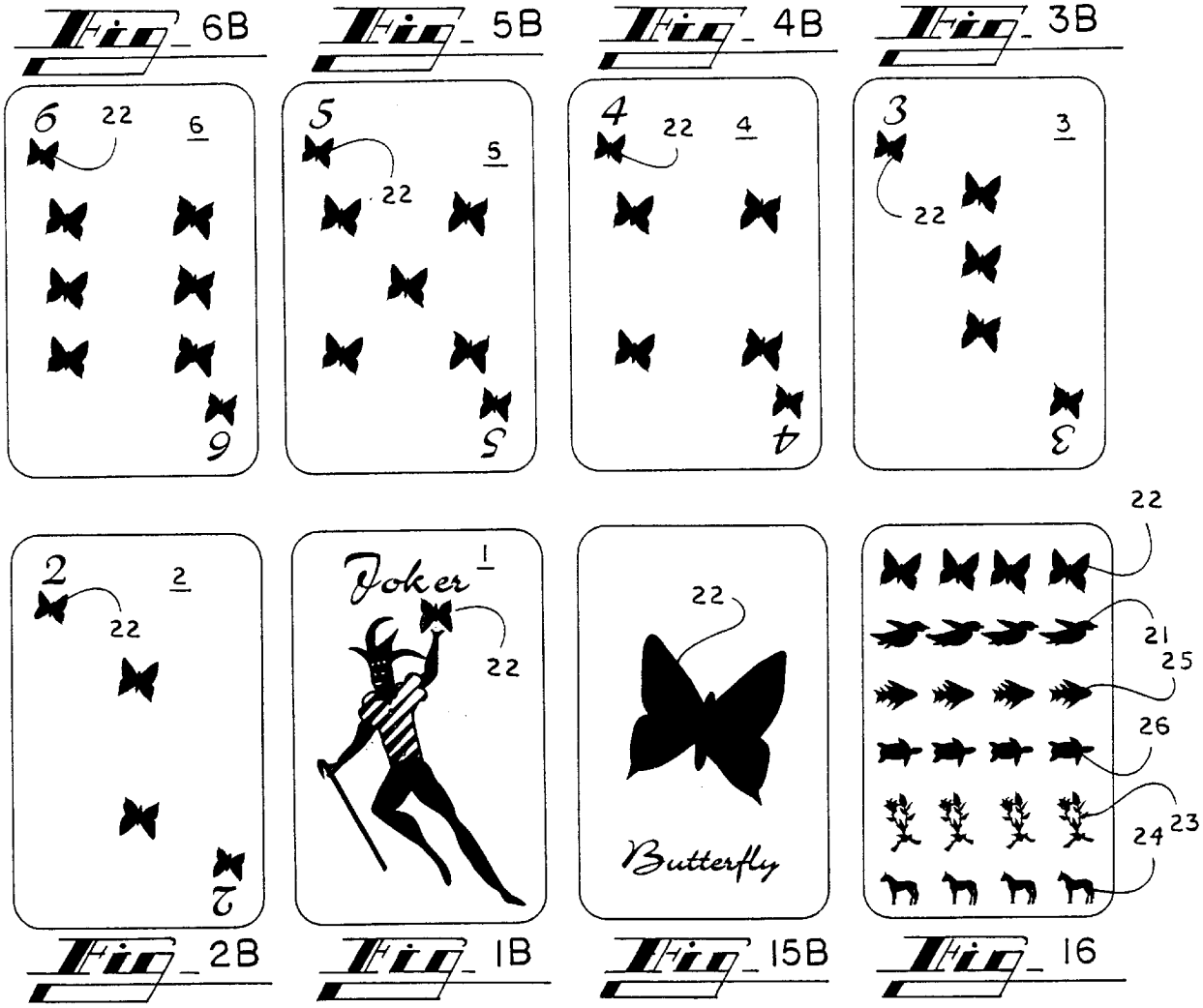

The card game of the present invention is titled "Challenge" for reasons which will become apparent from the description that follows. The card game include six sets of cards designed for the invention. Each set of cards consists of six suits. Each suit consists of 14 cards which follows the sequence of: Jokers, 2, 3, 4, 5, 6, 7, 8, 9, 10, J, Q, K, A. The six suits are: Bird, butterfly, flower, horse, fish, turtle. Each set of cards includes:

Six cards, (1) designated Jokers, one (bird, butterfly, flowers, fish) is shown in FIGS. 1A, 1B, 1C, 1E and two Jokers with $ indicia one is shown with the turtle suit and one is shown with the horse suit.

Six cards (2) designated 2 one of a particular suit is shown in FIGS. 2A, 2B, 2C, 2D, 2E, 2F.

Six cards (3) designated 3 one of a particular suit is shown in FIGS. 3A, 3B, 3C, 3D, 3E, 3F.

Six cards (4) designated 4 one of a particular suit is shown in FIGS. 4A, 4B, 4C, 4D, 4E, 4F.

Six cards (5) designated 5 one of a particular suit is shown in FIGS. 5A, 5B, 5C, 5D, 5E, 5F.

Six cards (6) designated 6 one of a particular suit is shown in FIGS. 6A, 6B, 6C, 6D, 6E, 6F.

Six cards (7) designated 7 one of a particular suit is shown in FIGS. 7A, 7B, 7C, 7D, 7E, 7F.

Six cards (8) designated 8 one of a particular suit is shown in FIGS. 8A, 8B, 8C, 8D, 8E, 8F.

Six cards (9) designated 9 one of a particular suit is shown in FIGS. 9A, 9B, 9C, 9D, 9E, 9F.

Six cards (10) designated 10 one of a particular suit is shown in FIGS. 10A, 10B, 10C, 10D, 10E, 10F.

Six cards (11) designated J one of a particular suit is shown in FIGS. 11A, 11B, 11C, 11D, 11E, 11F.

Six cards (12) designated Q one of a particular suit is shown in FIGS. 12A, 12B, 12C, 12D, 12E, 12F.

Six cards (13) designated K one of a particular suit is shown in FIGS. 13A, 13B, 13C, 13D, 13E, 13F.

Six cards (14) designated A one of a particular suit is shown in FIGS. 14A, 14B, 14C, 14D, 14E, 14F.

The indicia of: Jokers, 1, 2, 3, 4, 5, 6, 7, 8, 9, 10, J, Q, K, A designate hierarchical rank of the card in one suit relative to other cards in that same suit for purposes that will become apparent when the method of play is described. The lower rank is Joker and the highest indicia is A. Notice A is an abbreviation for Aces. K is an abbreviation for Kings, Q is an abbreviation for Queens, J is an abbreviation for Jacks.

FIGS. 1A–14A have an indicia 21 in the upper left which designates the bird suit.

FIGS. 1B–14B have an indicia 22 in the upper left which represents the butterfly.

FIGS. 1C–14C have an indicia 23 in the upper left which represents flowers.

FIGS. 2D–14D have an indicia 24 in the upper left which represents horses.

FIGS. 1E–14E have an indicia 25 in the upper left which represents fish.

FIGS. 2F–14F have an indicia 26 in the upper left which represents turtle.

Figures 1D, 2D, 3D, 4D, 5D, 6D, 15D, 16:
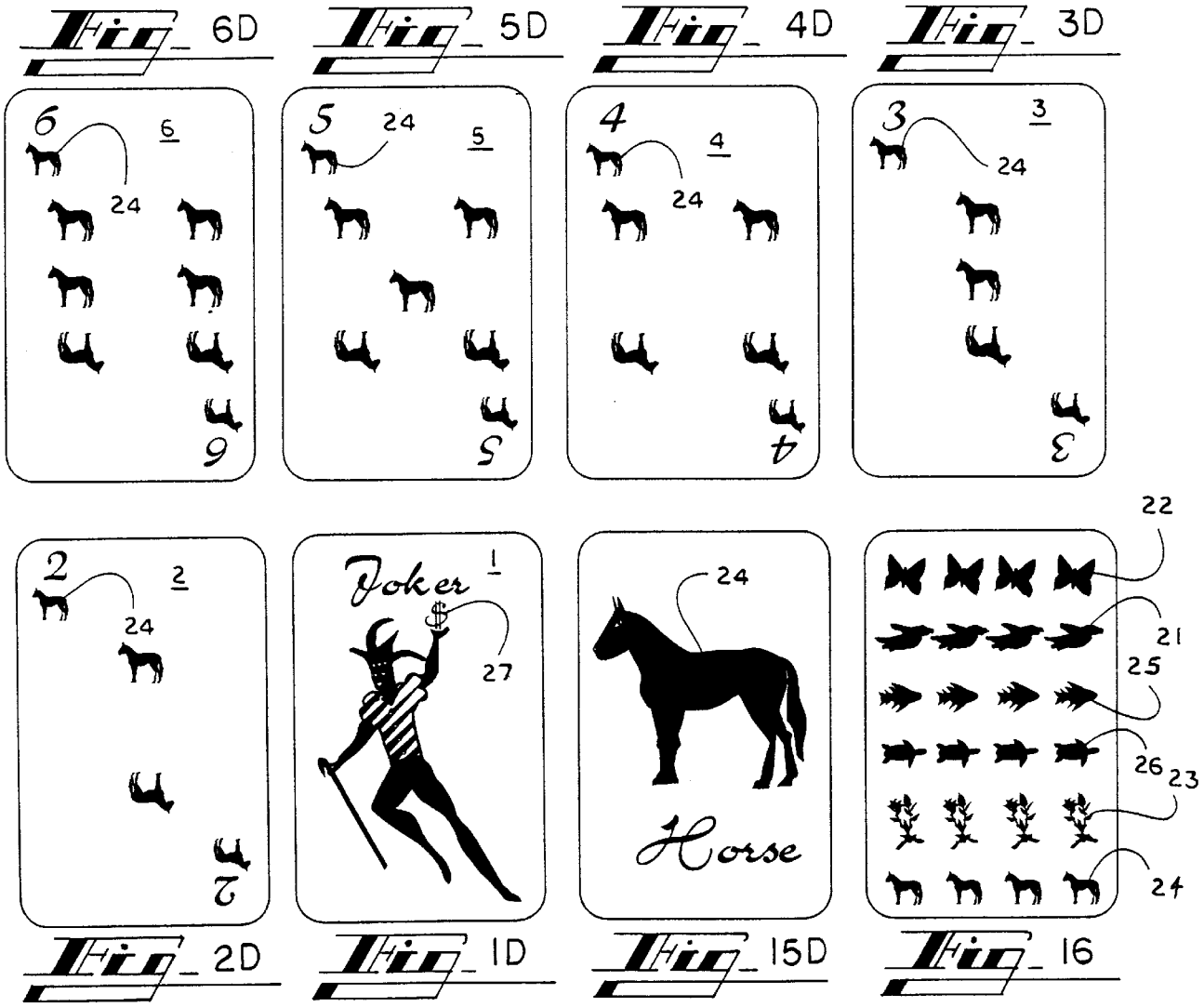
Figures 1E, 2E, 3E, 4E, 5E, 6E, 15E, 16:
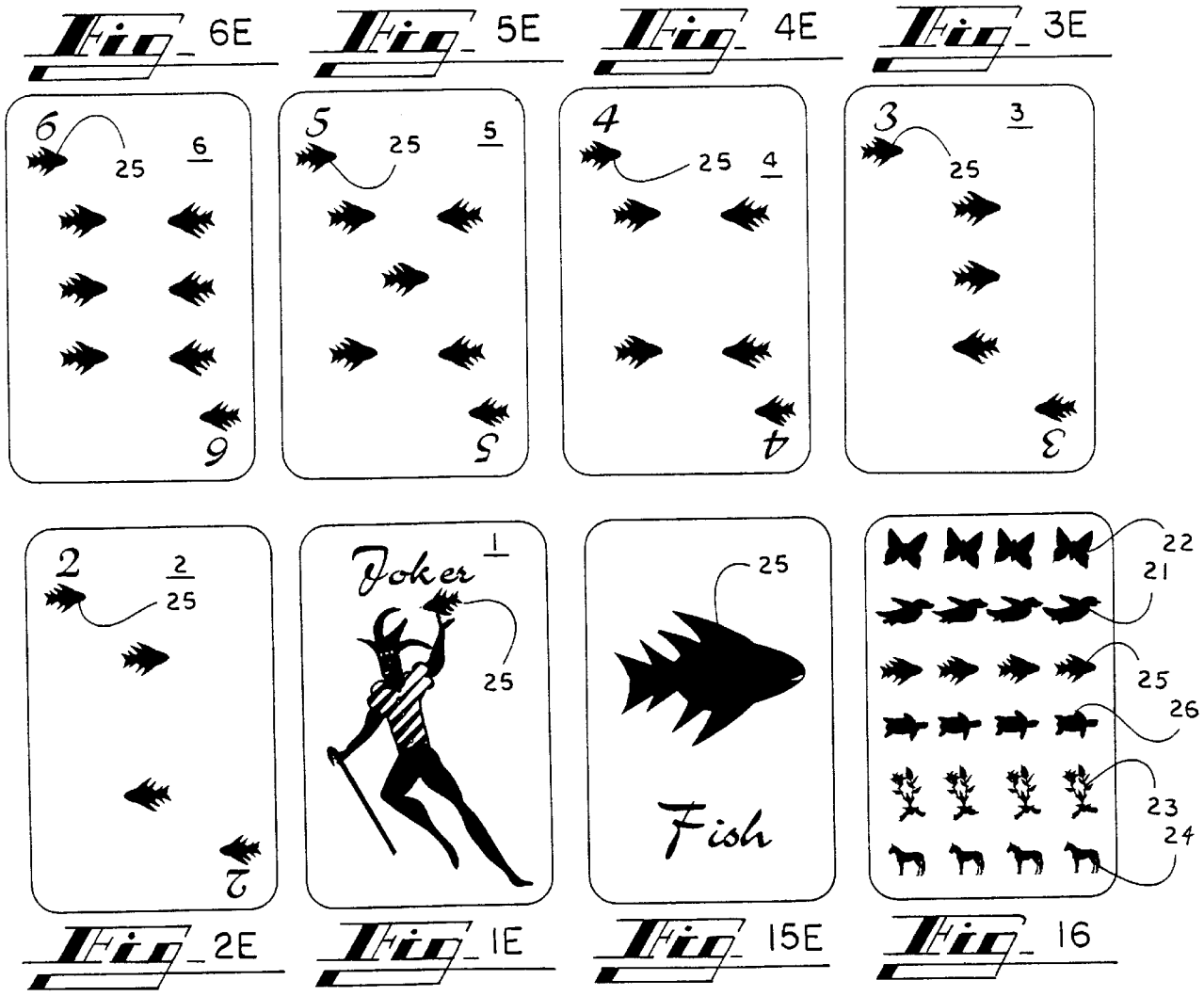
Figures 7A, 8A, 9A, 10A, 11A, 12A, 13A, 14A:
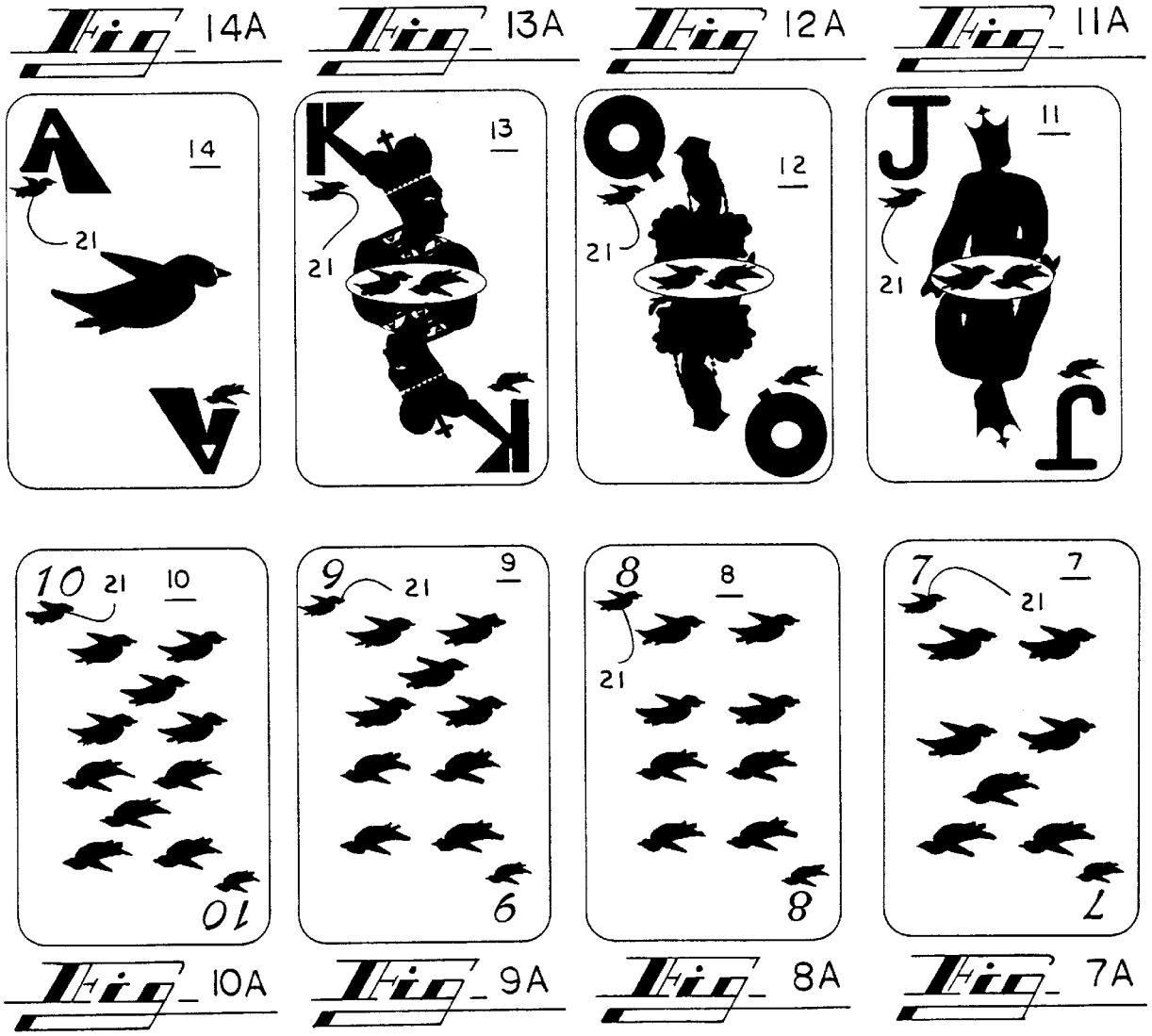
FIGS. 7A, 7B, 7C, 7D, 7E, 7F are plan views of the front faces of one type of card used in the card game of the present invention.
FIGS. 8A, 8B, 8C, 8D, 8E, 8F are plan views of the front faces of one type of card used in the card game of the present invention.
FIGS. 9A, 9B, 9C, 9D, 9E, 9F are plan views of the front faces of one type of card used in the card game of the present invention.
FIGS. 10A, 10B, 10C, 10D, 10E, 10F are plan views of the front faces of one type of card used in the card game of the present invention.
FIGS. 11A, 11B, 11C, 11D, 11E, 11F are plan views of the front faces of one type of card used in the card game of the present invention.
FIGS. 12A, 12B, 12C, 12D, 12E, 12F are plan views of the front faces of one type of card used in the card game of the present invention.
FIGS. 13A, 13B, 13C, 13D, 13E, 13F are plan views of the front faces of one type of card used in the card game of the present invention.
FIGS. 14A, 14B, 14C, 14D, 14E, 14F are plan views of the front faces of one type of card used in the card game of the present invention.
Figures 7B, 8B, 9B, 10B, 11B, 12B, 13B, 14B:
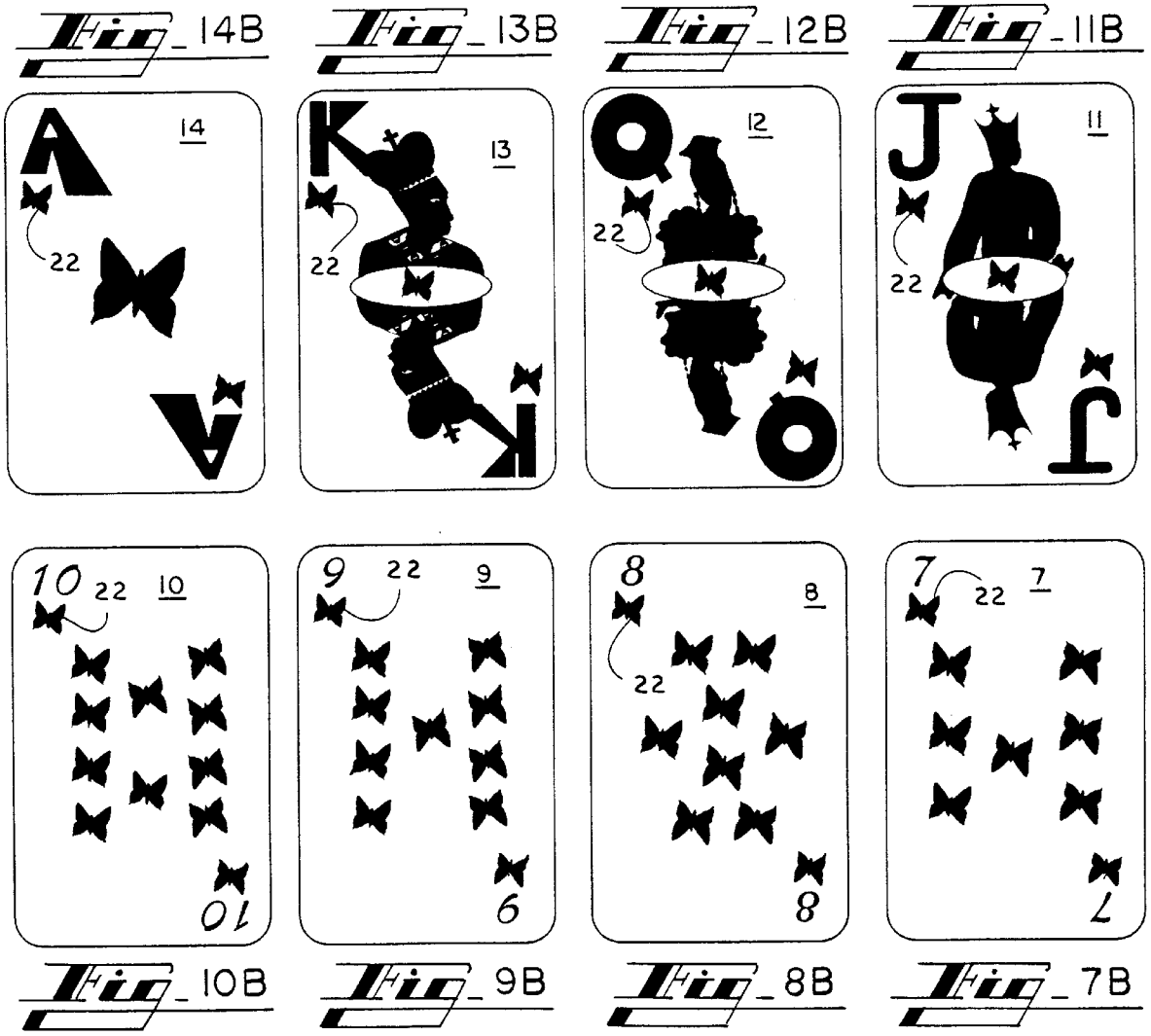
Figures 7C, 8C, 9C, 10C, 11C, 12C, 13C, 14C:
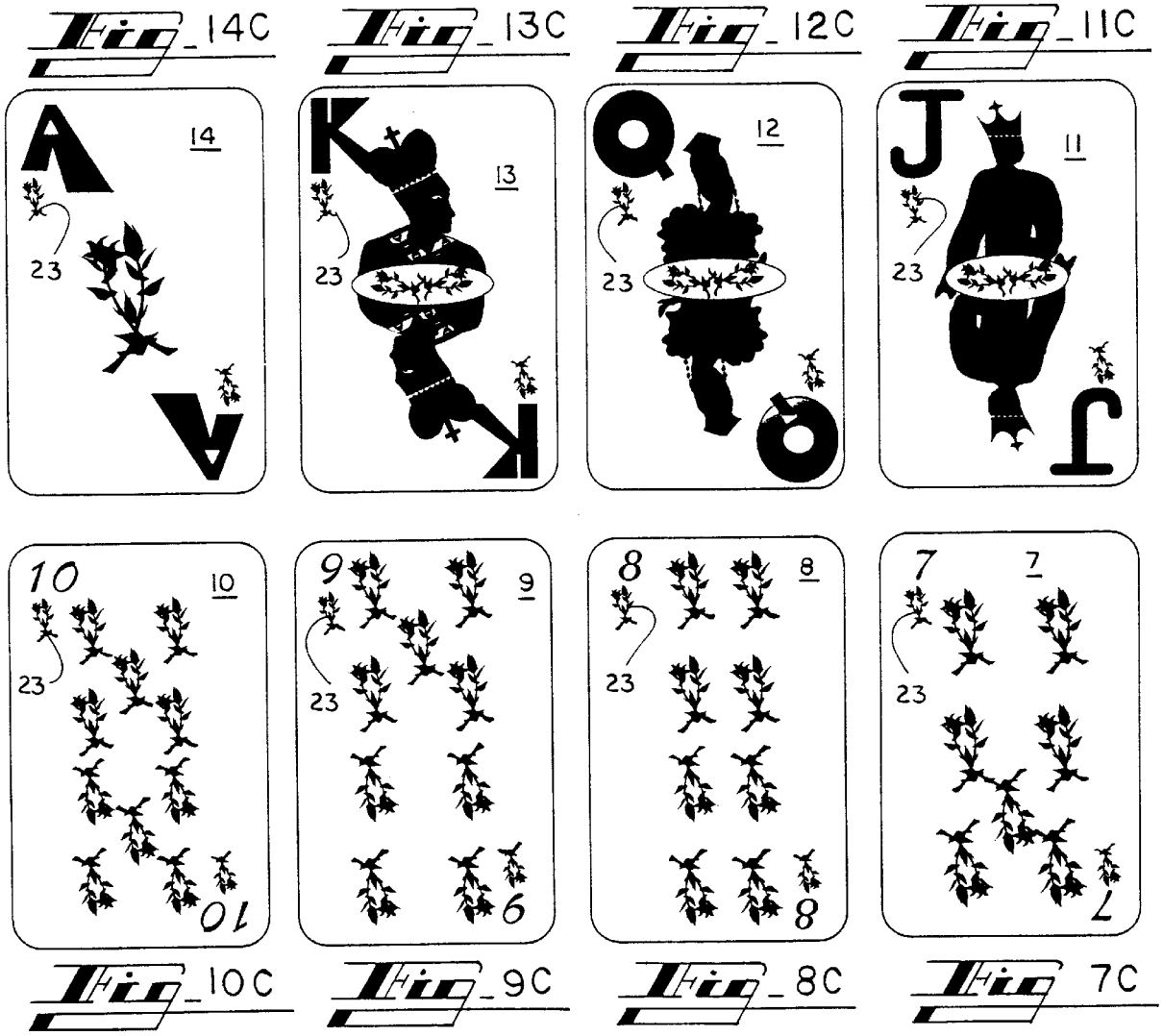
Figures 7D, 8D, 9D, 10D, 11D, 12D, 13D, 14D:
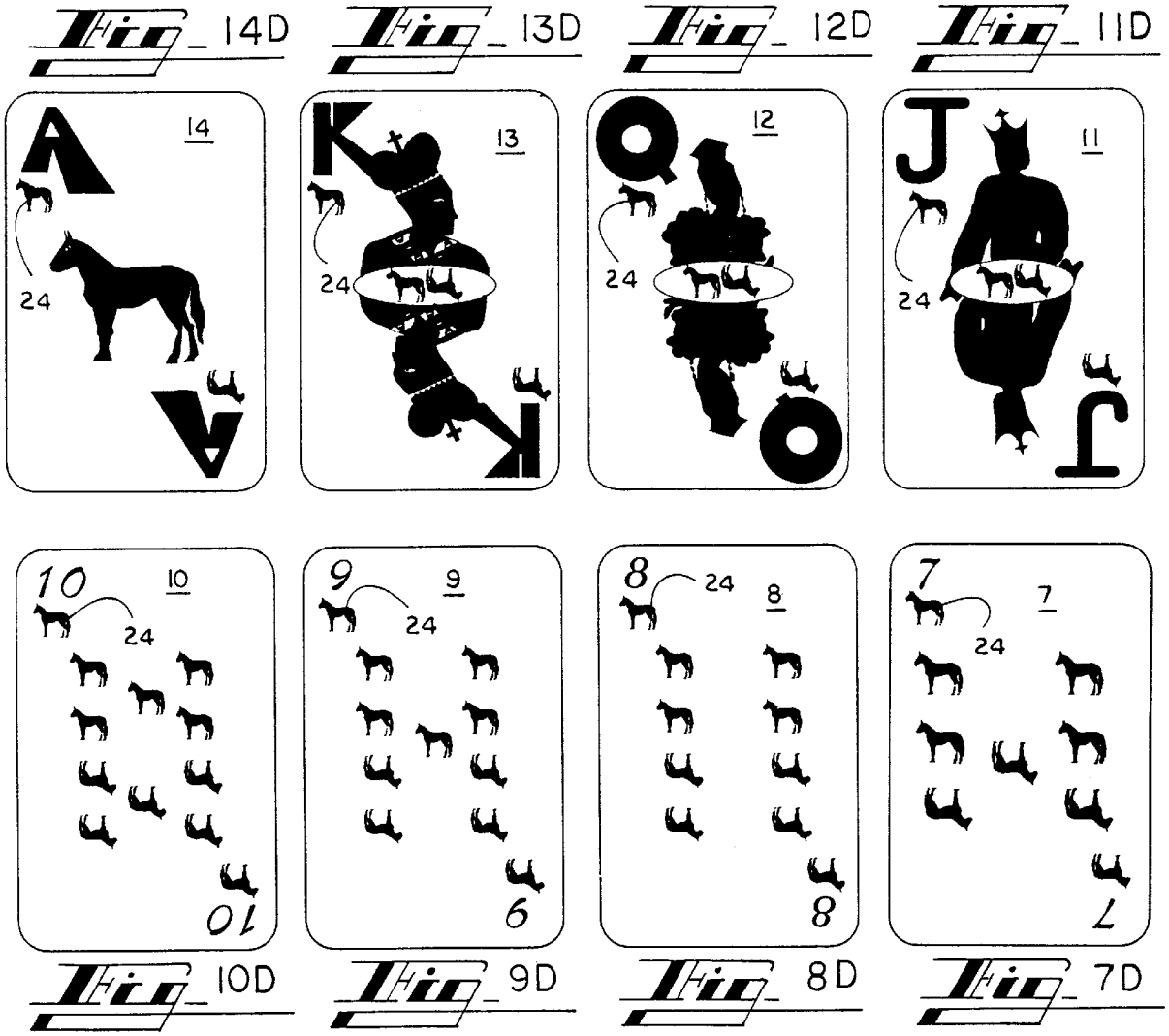
Figures 7E, 8E, 9E, 10E, 11E, 12E, 13E, 14E:
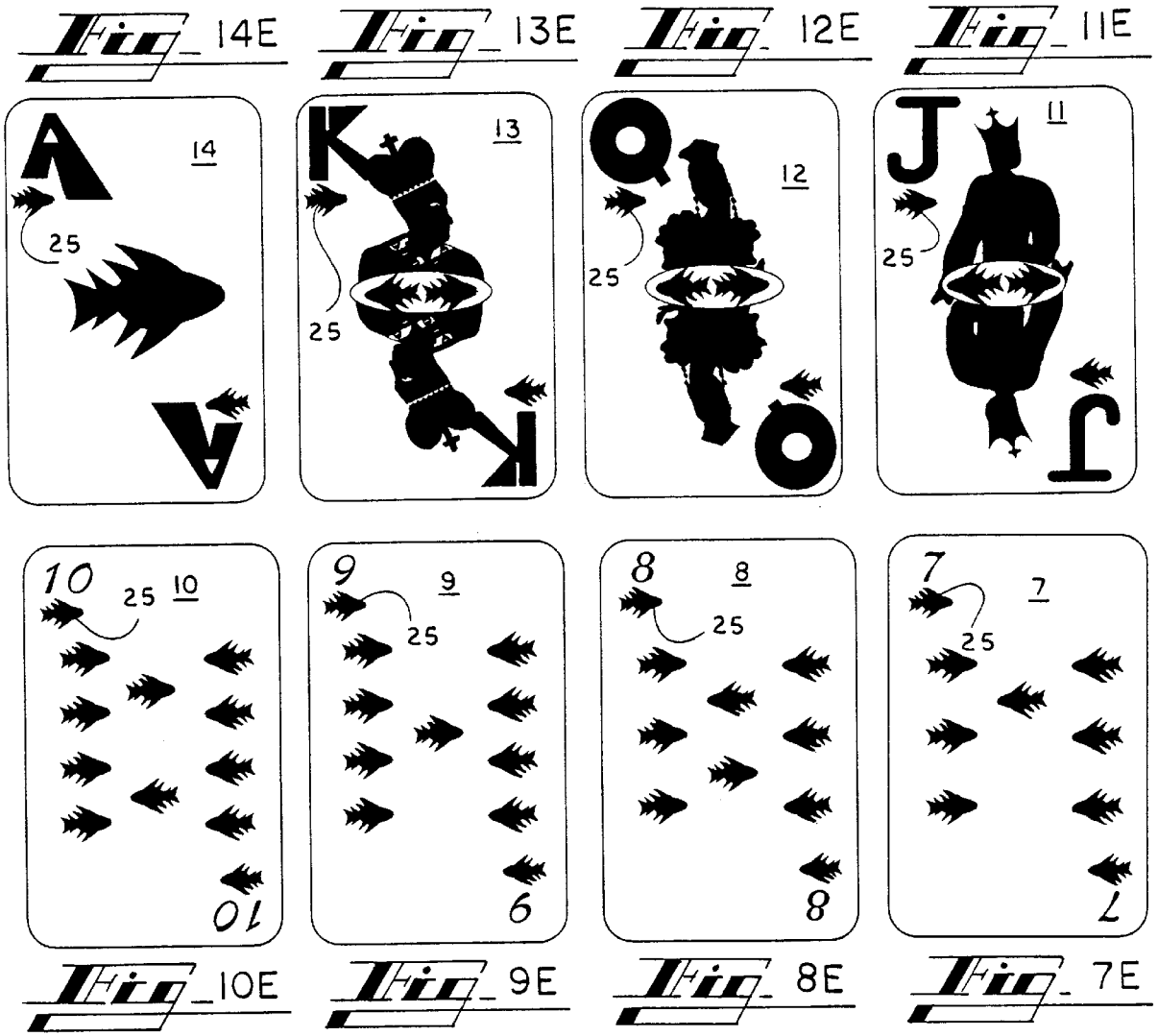
Figures 7F, 8F, 9F, 10F, 11F, 12F, 13F, 14F:
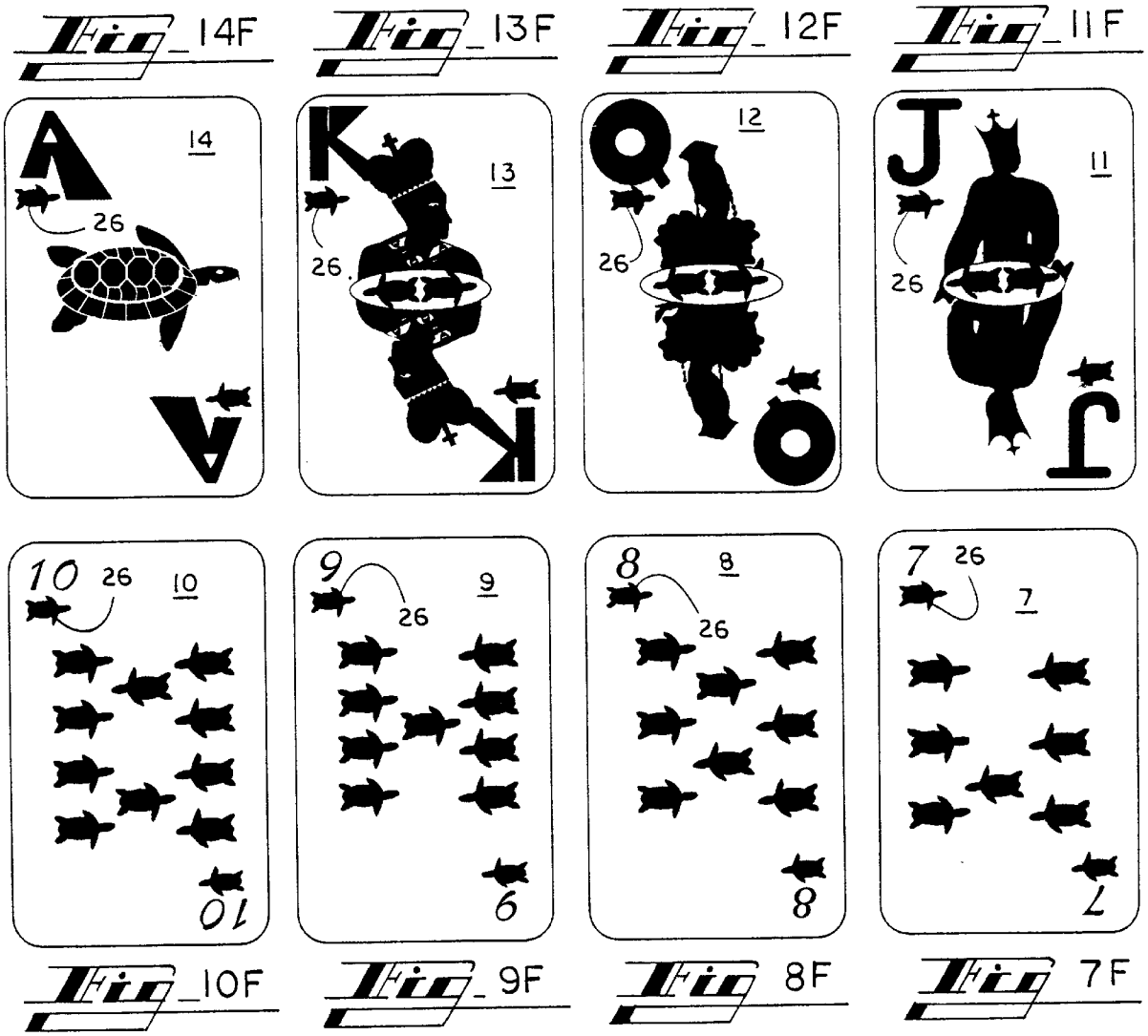

FIGS. 1D, have a $Joker indicia which will become apparent when the method of playing the card game of the invention is described. The rear face of each card illustrated in FIGS. 1A–14F can have suitable decorative indicia set forth thereon, depending on the manufacturer choice, an example is seen in FIG. 16.

Figures 17, 18, 19:
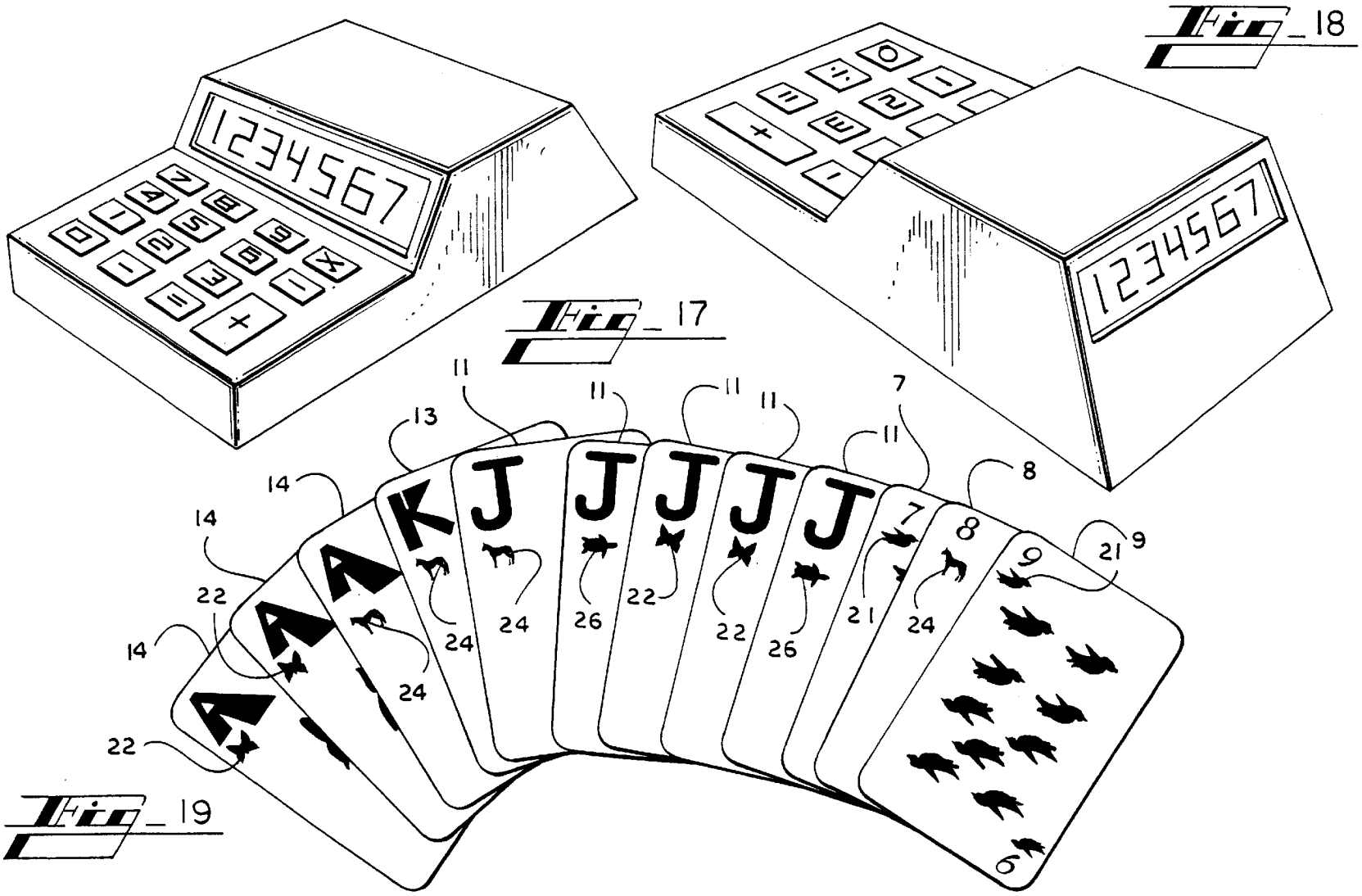
FIG. 17 is a front view of a scorulator used in the card game of the present invention.
FIG. 18 is a rear view of a scorulator used in the card game of the present invention.
FIG. 19 is the illustration of a typical player hand having 12 cards before any declaration.

The game is also provided with scorulators which keep track of players points. The scorulators as shown in FIGS. 17, 18. They are very simple instruments and could be manufactured by any electronic manufacturer. They are just mini calculators like those ones used in department stores or convenience stores where the clients can see the total amount recorded by the user. X shows digits from 0 to 9 and the +, −, ×, ÷ signs. Facing the user is a screen Y that shows each transactions to the user and in the rear face another screen Z shows to players or any spectators the transactions recorded by the user.

To summarize the above description, refer to the table depicted in FIG. 28 which is provided to illustrate the formation and values of declarations.

PLAYING THE GAME—"Challenge" will be probably the best known of all card games for two to eight players; there is no doubt that it is more skillful and interesting than any other card games. "Challenge" is played with six packs of cards designed specially for the game 6s, 5s, 4s, 3s, 2s, have been removed. The cards sequence goes as follow Aces, Kings, Queens, Jacks, 10s, 9s, 8s, 7s, Jokers.

To begin players lift a part of the pack and show the bottom cards to determine the dealers. Either the player who has the lowest card or his partner (if playing in partnership) will deal because there is a slight disadvantage in dealing. The six packs of cards are shuffled together. Twelve cards are dealt to each players, either three or four cards at a time. (The rest of the cards are placed face down on the table). The object of the game is to win tricks that include Tips or Aces and to declare certain combinations of cards that carry a scoring value. The player on the left of the dealer leads the first trick. Thereafter the winner of a trick leads to the next. The winner of a trick declares any combination that he/she has (if playing in partnership all the players in that partnership declare any combination that they have and the total points is added to their points in their scorulator). To declare the player places the cards face upwards on the table in front of him/her, where they remain until he/she decides to play them to a trick, or until the stock is exhausted. Declaring is subject to the three rules that follows.

1. Only one declaration can be made by a player at a turn. In partnership one by each player in the partnership.

2. For each declaration at least one card must be taken from the hand and placed on the table.

Figure 20:
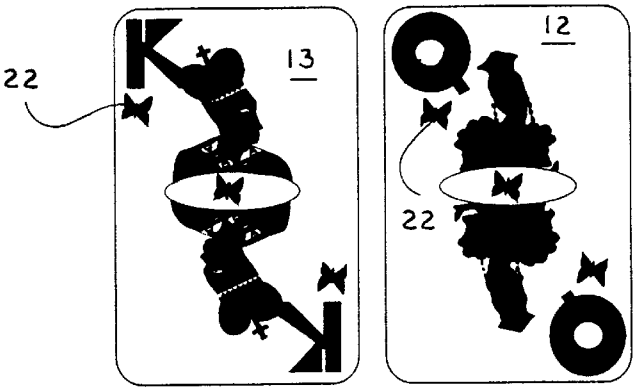
FIG. 20 is the illustration of a King and a Queen of the same suit which constitutes a marriage of the present invention.
Figure 21:
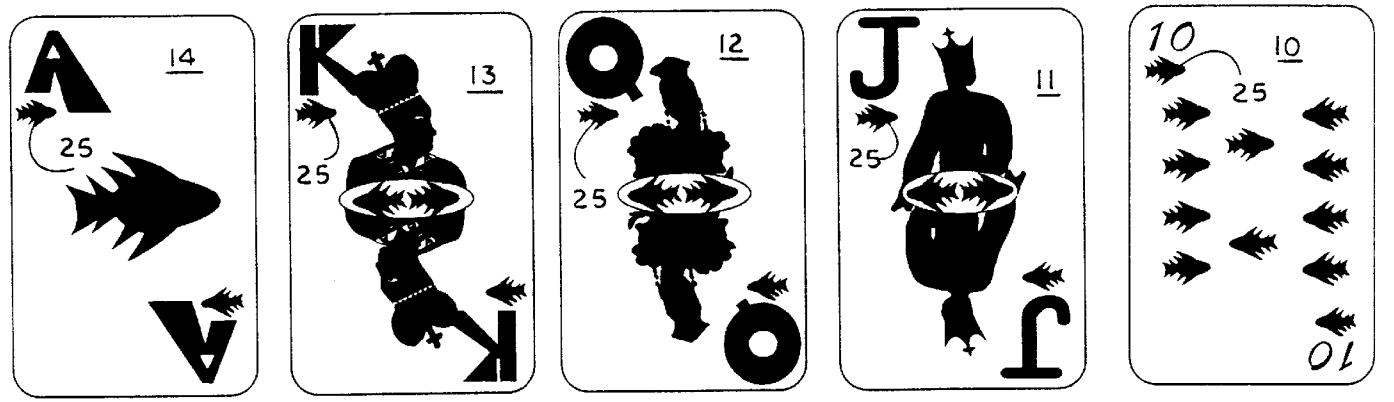
FIG. 21 is the illustration of an escalator sequence of the present invention.
Figures 22, 23:
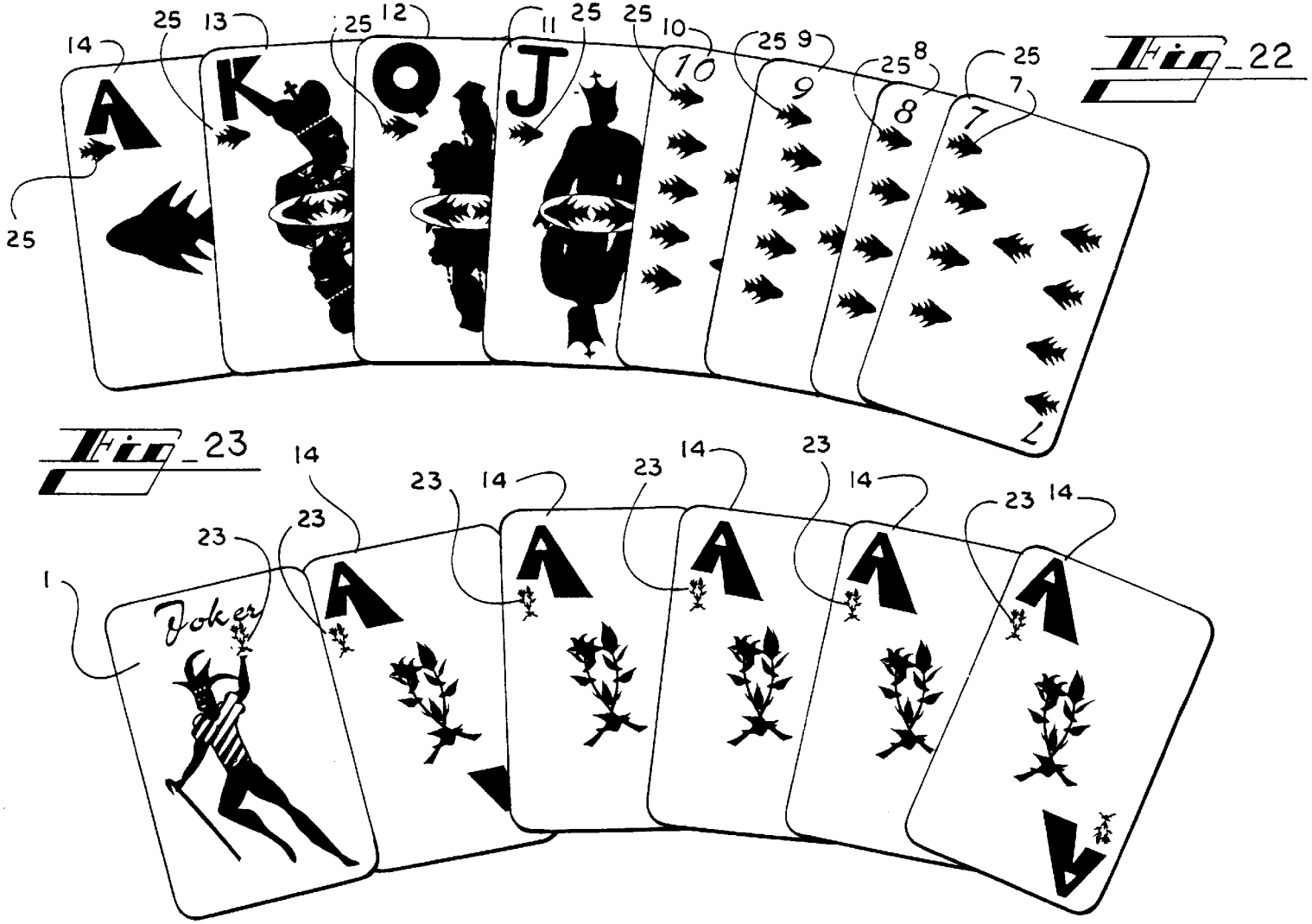
FIG. 22 is the illustration of a flush sequence of the present invention.
FIG. 23 is the illustration of 5 cards sequence and a Joker of the same suit of the present invention.
Figure 24:
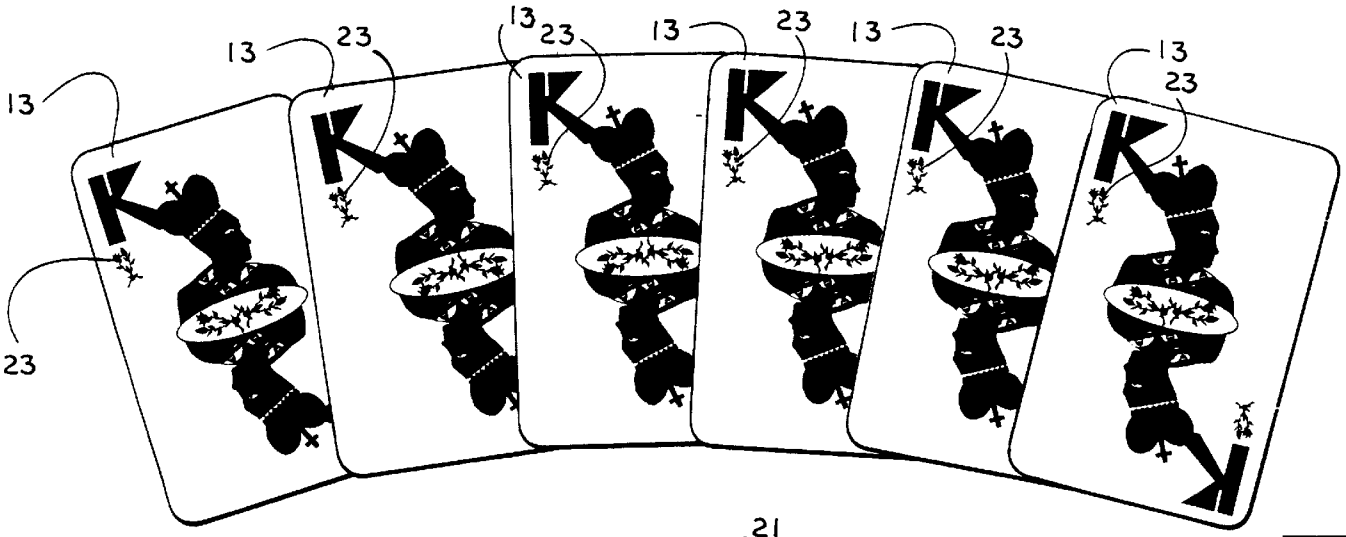
FIG. 24 is the illustration of six cards sequence of the present invention. (All being the same suit).
Figure 25:
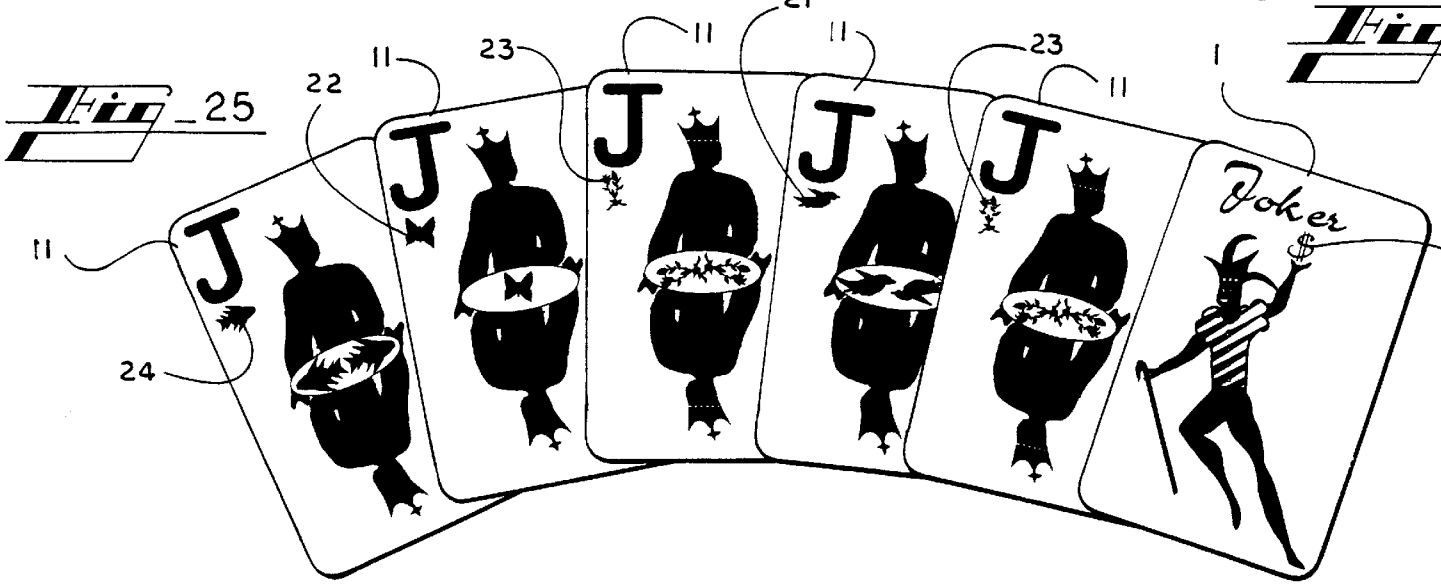
FIG. 25 is the illustration of a five different suits card and a Joker of the present invention.
Figure 26:
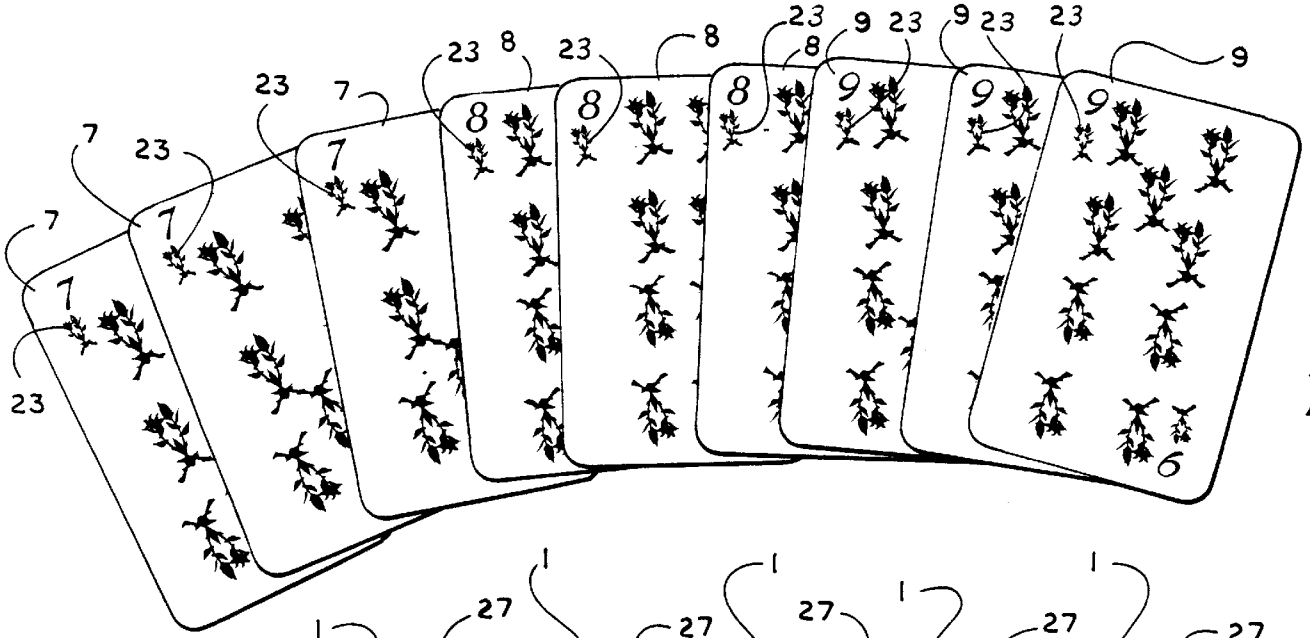
FIG. 26 is the illustration of a garbage sequence of the present invention.
Figure 27:
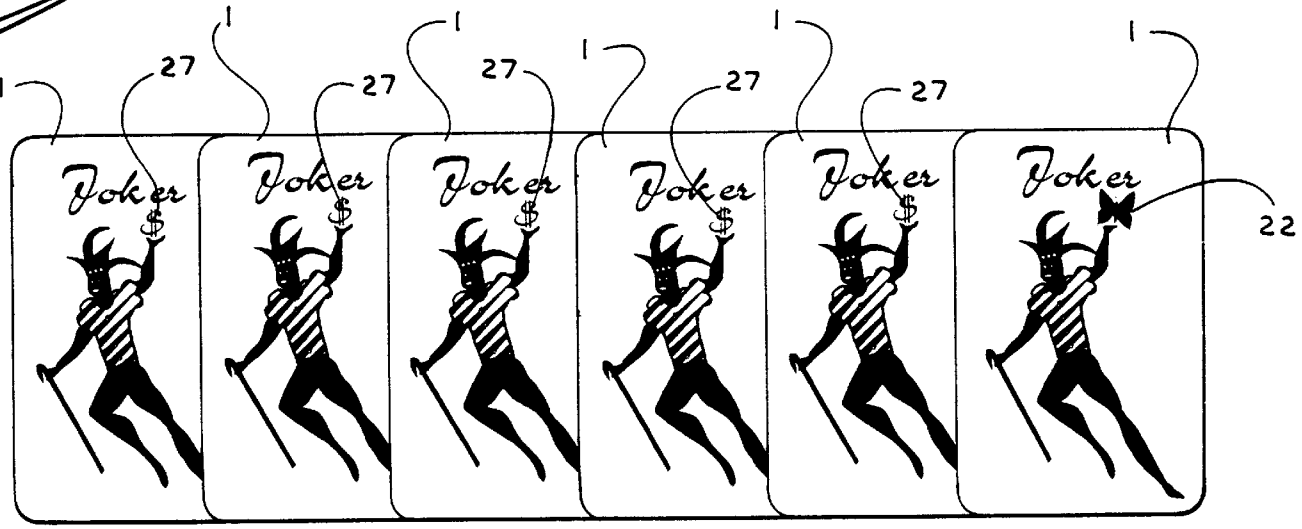
FIG. 27 is the illustration of (5) $Jokers sequence of the present invention.

3. A card already declared may be declared again so long as it is in a different class, or in a higher-scoring declaration of the same class. That is to say if bird is the trump, a player may declare K and Q as shown in FIG. 20 (bird) and score for the trump marriage, and later he may add (A, 10, J) and score for the escalator sequence. He cannot first declare (A, K, Q, J, 10) as shown in FIG. 21 (bird escalator sequence) and later declare the royal marriage. Refer to FIGS. 28, 29 (for declarations information (how to place your cards, how to declare and their values). A player can have a successive marriage of King and Queens of any suits. Pile them in front of him/her Kings over Kings, queens over Queens when he/she has a pile of five Kings or Queens if he/she gets one more King or 1 Queen from the stock he/she can declare it in addition to the first five Kings and gets 120 points for a sequence of six Kings but once those Kings are declared in a 120 points sequence and been married they cannot be declared anymore. Let's say the remaining Queens if for any reason the player has to play any or some of them, he/she can still accumulate more Queens and use the ones on the table and declare 90 points with a total of six Queens or 5 Queens and a Joker as shown in FIGS. 23, 24, or 25.

To avoid repetition it is recommended to refer to FIG. 28 for all the possibilities of declarations. Notice those same information about formations of declarations and values are also depicted in the summary of the game.

It is not compulsory to follow suit, and the card that is led holds the tricks unless a higher card of the same suit is played or a trump is played to the lead of a plain suit. 10 points is scored any time a player declares 7s of trump suit or 10 points is rewarded to the leader if he/she plays a 7s horses, 10 point to a non-leader if he/she plays 7s turtle. As points are scored for tips (which are 10s and Aces each has a value of 10 points), the tricks are gathered and stock to the winner's pile.

Here comes the best part of the game, certain declarations bring points to the declarer or his/her partnership and knock off points from the leader or his/her partnership. This explains that a player wins only when he/she reaches the total amount agreed upon. For example let's consider player A with a total of 700 points and player B with a total of 300 points. Player A by having more points is the leader. Being the leader is the player that can declare in horse. Player B having less points is the only player that can declare in Turtles. If for example player B declares 5 Aces turtles he will score 150 point which put his total to 450. He will also knock off 150 points from player A and lower down his total to 550 points. Let's say in the next trick player B declares Escalator sequence (which is trump suit ) that will give him 250 points to put his total to 700 points and he will also knock off 150 points from player A and lowers his total to 400. Then, now player B is the leader and player A cannot declare anymore in horse so does player B cannot declare in Turtle. Player B cannot knock off point from player A which has a lower total than he. Player A may have his revenge by declaring and using strategies so as to have points knocked off from the leader (which is player B). However player B should consider accumulating more points so to reach the goal which is the total amount of points agreed upon. Note the only time the leader can knock off points from his opponent is when the opponent plays a turtle card without making a declaration. (10 points will be deducted from that player). This rule does not apply in the last twelve tricks (i.e. when the stock is exhausted).

When a player wins a trick and declares, if the exposed cards show more than one declaration the player must announce which declaration he/she intends to score and leave the other to be scored when he/she wins another trick. Note a card that has once scored cannot again be used to form part of a similar declaration. As an example, FIG. 23, a player may score 5 Aces and announce that Ace's trump suit will be used for an escalator sequence. Note cards used in flush sequences cannot be used to declare escalator sequence and vice versa cards of escalator sequence cannot be used toward flush sequence. Escalator sequence cards may be declared in many fractions but flush sequence must be declared at once. It is true that after flush or escalator sequence declarations, either A, K, Q, or J, could be used individually towards other declarations. Flush garbage can only be declared in one declaration. Any 7's of the trump can be scored 10 points only when they are used to win a trick. The cards that have been declared, and therefore exposed on the table, remain a part of the player's hand and may be used with later tricks.

Tricks should be gathered and kept by the player who wins them, because at the end of a deal a player score 10 points for every Ace and every 10 that he has won. They are known as Tips. When all the players have played to a trick, they replenish their hands from the stock, winner takes first and followed by the next player.

No declaration may be made after the last card of the stock has been drawn. The players then pick up any cards they have on the table and play off the last twelve tricks. A player now must follow suit to the card led during the hand. The player plays any card that he/she feels like playing. But in that last moment when the stock is exhausted, once the winner of a trick plays, every player must try to play the same suit that the winner plays, accordingly the one with higher rank in that suit wins the trick. If you do not have the suit that is played, you can play any other card. But also you could play any trump to any other suit and win the trick. Remember that in a trick where they are more than one trump, the person with the higher rank trump wins the trick. Since no further declarations may be made the aim of the player is to win Tips and the last tricks for which 10 points are scored. The winner of the last trick counts his/her Tips first if he/she totaled the 1000 points or the number of points agreed upon, it doesn't matter if the opponents have more Tips and will total more points. The rule of the game is that the winner of the last trick counts first and wins if he/she has a total of 1000 points or above. Then, if not, the opponent wins, if counting Tips, his total is 1000 points or above.

The last twelve tricks are now played off. During this period of play a player must follow suit if he/she can to the card led; if he/she cannot, he/she must trump or overtrump the trick if he/she holds a trump. If a trump is led the next player must play trump if he/she had any. If identical cards are played, the one first to be played wins the trick, if the trick is to be won by the card. During the game the winner will be he/she who first reaches an agreed figure.

Figures 29A, 29B, 29C, 29D, 29E:
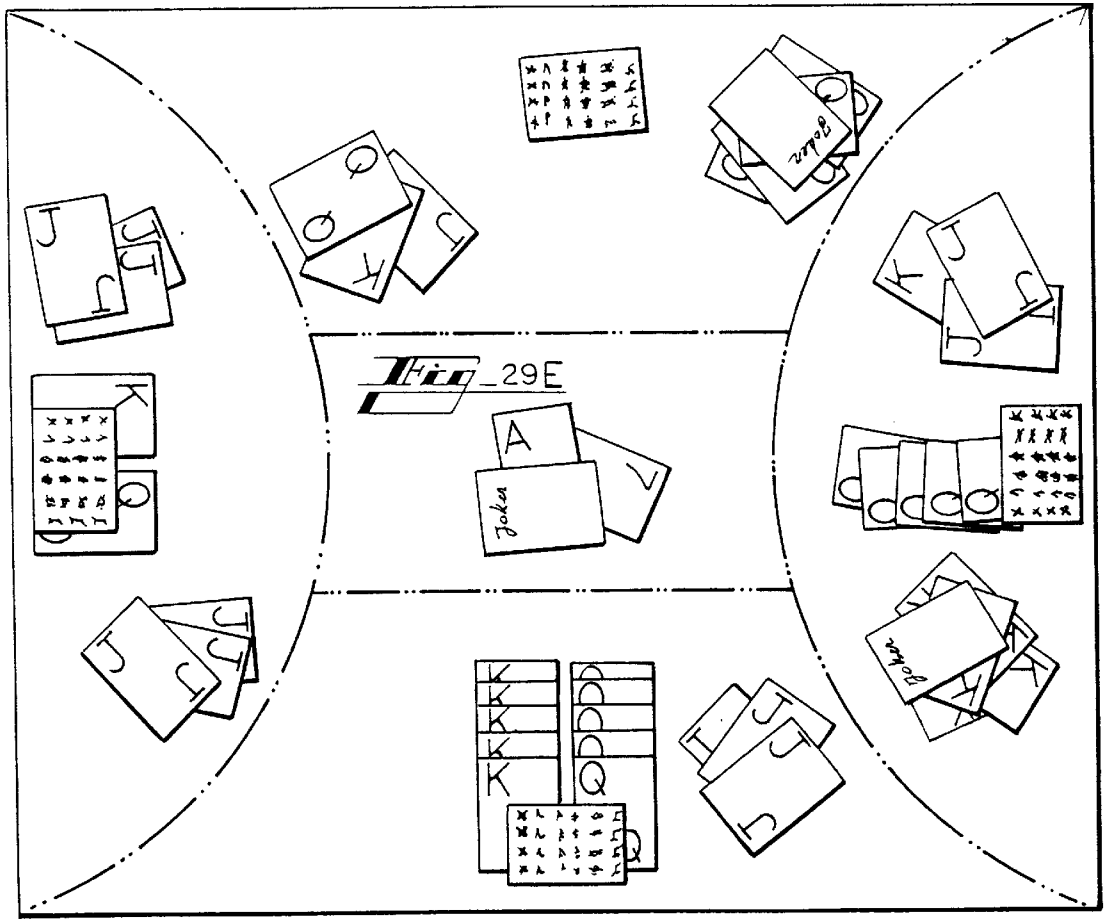
FIGS. 29A, 29B, 29C, 29D, 29E are illustrations on how to place effectively your cards after declarations.

It is important for players to arrange the cards in their hands at the beginning of each hand. The card should be arranged by suit or by declaration sequences. It is necessary to keep them synchronized as you play and replenish your hands. Cards on the table that are part of your hands should also be arranged in a way to make it easy for you and your opponent(s) to keep track of the cards that are good for future declarations and those that are not. To achieve such discipline in playing, the first marriage K and Q declared should go right there in front of you under your pile (cards captivated) as shown in FIG. 29A. Any marriage that follows K go under K and Q go under Q in a way to make the letter K and letter Q visible as shown in FIG. 29B.

To summarize how to arrange cards, refer to FIGS. 29A, 29B, 29C, 29D, 29E and follow these steps.

In a declaration:

(a) cards that cannot combine to any future declaration go on your left.

(b) cards that will be held for future declaration will go on your right.

(c) trump cards that are needed for the safety of being able to cut in a future trick are also kept on the right. One thing, you need to make sure you tell what is held for future declaration and the sequence it is held for.

(d) newly declared marriage (K and Q) go in front of you under your pile as shown in FIG. 29C.

(e) naturally, cards that are played in the current trick go in the center of the table as shown in FIG. 29E.

FIGS. 29A, 29B, 29C, 29D, 29E are shown for illustration on how to place effectively your cards after declarations.

FIG. 29A is the illustration of a player after declaring 6 Js sequence. Notice these regular Js are placed on the left side and three trump Js are placed on the right side. The Js on the left have no future value in this hand while those trump Js can be used to cut any other suit in a trick if necessary and secondly some of those trump Js may also be used for escalator sequences. We also realize there is a K and Q under the pile in front of the player in FIG. 29A. This is the way first marriage should be placed. And, every K and Q that follows goes under a K or a Q up to five since the sixth will be put on the table while declaring.

FIG. 29B is an illustration of when the Js cards on the left hand side have been played and where the player had arranged successively five Ks and five Qs and looking for either his next K, Q, or Joker to declare. Notice the three trump Js are still saved. They are really needed for the player to cut when a K or Q or a Joker is found while the player is replenishing his/her hand so he/she can declare.

FIG. 29C shows the period after the player had found a Joker from the stock. We can see that he had placed the plain Ks and the Joker on the left which means they have no future value while the trump K joined the two left over trump Js. One of the trump Js had been used to cut the trick for that declaration. Notice also the way the Qs are kept under the pile since they are needed for next declaration.

FIG. 29D shows the period after the player had declared the Qs. Here again, we see that the plain Qs on the left, the trump Q joins the trump K and J on the right. Now, at this point the player has two possibilities. If he collects six aces, he can declare 6 aces sequence and add any trump ace to the trump K, Q, J, and looks for a trump 10 to declare escalator. While, if he can find a trump A and a trump 10, he can declare escalator and save the trump A for future six aces declaration.

We must understand that if the player has to declare flush sequence, he must have a brand new trump J because K and Q are the only cards on any other declaration that can be used for a flush sequence. All the cards left in the sequence must come from the player's hand and be placed on the table at once. Refer to FIGS. 21 and 22 about escalator and flush sequences. All nine cards must come from the player's hand for flush garbage sequences.

At "Challenge" skill and experience counts for much. An ability to remember which cards have been played contributes much toward success. When it comes to playing off the last twelve cards, the experienced player will never be in any doubt about which cards his/her opponent(s) hold(s). Thus, when playing to the last trick before the stock is exhausted, a player should be able to weigh up the merits of winning the trick and declaring, preventing his/her opponent from declaring, or losing the trick and so obtaining the exposed trump card to add to his/her trump length in the final play off.

It must be understood that as used herein, the term "card game" is intended to include conventional table/board type game wherein one or more persons deals actual playing cards to one or more players, as well as any type of mechanical or electronic device which displays indicia of playing cards. That is the spirit of the present invention embraces a gaming device having an electronic touch sensitive screen which is controlled, at least in part, by a player touching images on the screen. And, also a gaming device wherein input from a player is supplied to a device through actuation buttons.

The principles, preferred embodiments and modes of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations, changes, and equivalents which follow in the spirit and scope of the present invention as defined in the claims be embraced thereby.

What is claimed is:

1. A card game for play by at least two players, wherein a score is maintained, comprising:

a plurality of cards divided into six sets of cards, each of said set divided into six different suits, wherein said plurality of cards have a hierarchical sequence.

2. The card game of claim 1, wherein said plurality of cards comprises five hundred and four cards and wherein each of said suits comprises fourteen cards.

3. The card game of claim 2, wherein said fourteen cards represent Joker, 2, 3, 4, 5, 6, 7, 8, 9, 10, Jack, Queen, King and Ace.

4. The card game of claim 1, further comprising scoring means for recording the scores.

5. The card game of claim 1, further comprising a first indicia on said plurality of cards for representing the hierarchical rank of each of said plurality of cards, and a second indicia on said plurality of cards for representing said suit of each of said plurality of cards.

6. A card game for play by at least two players in which players play groups of cards that include one or more cards, comprising five hundred and four cards divided into six sets of cards, each set including six different suits, and each suit of said set including fourteen cards for a total of eighty-four cards in each set of cards, said fourteen cards having a hierarchical sequence representing Joker, 2, 3, 4, 5, 6, 7, 8, 9, 10, Jack, Queen, King, and Ace, each set of cards comprising:

(a) six cards each having two indicia on their front face thereof, a first indicia representing a hierarchical rank of "Joker", and a second indicia representing a suit indicia, wherein four of said six cards having a suit indicia corresponding to four of said six different suits, wherein four of said cards representing a different suit, and the remaining two cards having a second indicia representing a "$" sign;

(b) six cards each having two indicia on their front face thereof, a first indicia representing the hierarchical rank of "2", and a second indicia representing a suit indicia corresponding to each of said six different suits, wherein each of said six cards representing a different suit;

(c) six cards each having two indicia on their front face thereof, a first indicia representing the hierarchical rank of "3", and a second indicia representing a suit indicia corresponding to each of said six different suits, wherein each of said six cards representing a different suit;

(d) six cards each having two indicia on their front face thereof, a first indicia representing the hierarchical rank of "4", and a second indicia representing a suit indicia corresponding to each of said six different suits, wherein each of said six cards representing a different suit;

(e) six cards each having two indicia on their front face thereof, a first indicia representing the hierarchical rank of "5", and a second indicia representing a suit indicia corresponding to each of said six different suits, wherein each of said six cards representing a different suit;

(f) six cards each having two indicia on their front face thereof, a first indicia representing the hierarchical rank of "6", and a second indicia representing a suit indicia corresponding to each of said six different suits, wherein each of said six cards representing a different suit;

(g) six cards each having two indicia on their front face thereof, a first indicia representing the hierarchical rank of "7", and a second indicia representing a suit indicia corresponding to each of said six different suits, wherein each of said six cards representing a different suit;

(h) six cards each having two indicia on their front face thereof, a first indicia representing the hierarchical rank of "8", and a second indicia representing a suit indicia corresponding to each of said six different suits, wherein each of said six cards representing a different suit;

(i) six cards each having two indicia on their front face thereof, a first indicia representing the hierarchical rank of "9", and a second indicia representing a suit indicia corresponding to each of said six different suits, wherein each of said six cards representing a different suit;

(j) six cards each having two indicia on their front face thereof, a first indicia representing the hierarchical rank of "10", and a second indicia representing a suit indicia corresponding to each of said six different suits, wherein each of said six cards representing a different suit;

(k) six cards each having two indicia on their front face thereof, a first indicia representing the hierarchical rank of "Jack", and a second indicia representing a suit indicia corresponding to each of said six different suits, wherein each of said six cards representing a different suit;

(l) six cards each having two indicia on their front face thereof, a first indicia representing the hierarchical rank of "Queen", and a second indicia representing a suit indicia corresponding to each of said six different suits, wherein each of said six cards representing a different suit;

(m) six cards each having two indicia on their front face thereof, a first indicia representing the hierarchical rank of "King", and a second indicia representing a suit indicia corresponding to each of said six different suits, wherein each of said six cards representing a different suit;

(n) six cards each having two indicia on their front face thereof, a first indicia representing the hierarchical rank of "Ace, and a second indicia representing a suit indicia corresponding to each of said six different suits, wherein each of said six cards representing a different suit;

(o) each of said eighty-four cards in paragraphs (a)–(n) above having six indicia on their rear face thereof, said six indicia representing all six suit indicia of said six different suits, wherein the rear face of said eighty-four cards are identical; and, (p) scoring means for recording the scores.

7. The card game of claim 6, wherein said scoring means is a calculator.

* * * * *